United States Patent [19]

Berbeco

[11] 4,150,418

[45] Apr. 17, 1979

[54] ELECTRICALLY CONDUCTIVE FOOTWEAR

[75] Inventor: George R. Berbeco, West Newton, Mass.

[73] Assignee: Charleswater Products, Inc., Wellesley Hills, Mass.

[21] Appl. No.: 824,051

[22] Filed: Aug. 12, 1977

[51] Int. Cl.[2] ..... A61N 1/14

[52] U.S. Cl. ..... 361/224

[58] Field of Search ..... 361/212, 223, 224

[56] References Cited

U.S. PATENT DOCUMENTS

| | | | |
|---|---|---|---|
| 3,337,770 | 8/1967 | Saraceni et al. | 361/223 |
| 3,359,658 | 12/1967 | Price | 361/223 |
| 3,381,173 | 4/1968 | Woskin | 361/223 |
| 3,387,180 | 6/1968 | Zipf | 361/223 |
| 3,648,109 | 3/1972 | Tims et al. | 361/223 |
| 3,801,868 | 4/1974 | Bryant | 361/224 |

*Primary Examiner*—Gerald Goldberg

*Attorney, Agent, or Firm*—Richard P. Crowley

[57] ABSTRACT

An article on manufacture which comprises footwear characterized by electrically conductive properties to prevent the accumulation of static charge on the footwear by the user thereof in a hazardous environment, which footwear includes a thin, flexible, nonwoven, fibrous sheet material containing a binding agent for the fibers, and impregnated generally uniformly therethrough with an electrically conductive amount of an electrically conductive particulate material.

15 Claims, 2 Drawing Figures

ELECTRICALLY CONDUCTIVE FOOTWEAR

BACKGROUND OF THE INVENTION

Footwear, having electrically conductive properties, is desirable for use in environments where the user does not want to build up a static charge on his body which might create spontaneously a spark or discharge in a hazardous-type environment, such as an operating room filled with combustible gases, or an environment containing volatile solvents vapors, sensitive instrumentation and the like. Typically in an operating room, the doctors and operating personnel employ relatively cheap and inexpensive slippers or shoe covers which contain on the floor-contacting or lower surface thereof a strip of conductive material to enable the personnel to be connected electrically to a ground potential, and in most cases the floor itself. Operating-room slippers or shoe covers have been employed with a nonwoven polyester strip having an electrical coating of carbon black on both sides, with the nonwoven carbon-black-coated strip either sewn or adhesively bonded or secured otherwise to the bottom of the slippers or shoe covers to make the operating slippers or shoe covers have electrically conductive properties. The nonwoven carbon-black-coated strip is quite thin, and inhibits or prevents, by being electrically conductive, the buildup of static charge on the user of the slippers or shoe covers to which the strip is secured.

It is, therefore, desirable to provide footwear having electrically conductive properties, and particularly to provide an improved, economical, easily manufactured, disposable slipper or shoe cover for use by operating-room personnel.

SUMMARY OF THE INVENTION

My invention relates to improved footwear having antistatic properties and a method of manufacturing and employing such footwear, and in particular relates to slippers, particularly for use in an operating room, containing a bottom surface of a thin antistatic or electrically conductive material, and the method of preparing such slippers.

My invention is directed toward improved footwear having antistatic properties to prevent the accumulation of static charge by the user of the footwear, and which footwear comprises footwear which has secured to the bottom floor-contacting portion thereof a thin flexible layer of a fibrous sheet material impregnated with a polymeric binding agent to bind together the fibers, and with an antistatic amount of a conductive particulate material, such as carbon-black particles. In particular, my invention is directed toward the employment of easily manufactured, economical and disposable slippers particularly designed for use in an operating-room environment containing combustible gases, such as ether, ethylene oxide and the like, and wherein the fibrous sheet material comprises a paper sheet material, such as a nonwoven, cellulosic, fibrous sheet material impregnated with an elastomeric-type binder, and containing an antistatic or electrically conductive amount of finely-divided, particulate, carbon-black particles dispersed about and generally uniformly throughout the cellulosic sheet material.

Typically, the conductive material employed in my footwear may vary, and may include finely-divided metal particles, such as silver, and aluminum and salts like aluminum silicate; although carbon-black particles are the preferred material. The amount of material employed should be sufficient to obtain the desired amount of antistatic or electrically conductive properties, and typically may range from about 2% to 20% by weight of the cellulosic sheet material. The particle size of the particles to be employed may vary, but typically in the preferred embodiment, finely-divided carbon-black particles, such as carbon black having a particle size of less than 40 millimicrons, and typically from 25 to 35 millimicrons, and a nitrogen surface area ranging from about 100 to 1200 square meters per gram are employed. The amount of particulate material employed should be insufficient to render inflexible the cellulosic fibrous sheet material and should be capable of being secured to the bottom portion of the footwear. Carbon black may be used alone or in combination with other materials.

The thin fibrous sheet material secured to the bottom of my footwear may be composed of a wide variety of both natural and synthetic fibrous materials, but particularly is composed of cellulosic fibrous material of a nonwoven type, such as in paper sheets, the cellulosic fibers bound together in sheet form by the employment of a polymeric-type binding agent, particularly a natural or synthetic elastomeric or polymeric material. In one preferred embodiment, the binding agent comprises an elastomeric/polymeric material, such as butadiene-styrene resin, or similar elastomeric materials, so that such material in use will impart also nonslip properties to the bottom of the footwear. Typical polymeric binders to be employed are those binders which are employed in the manufacture of paper sheets, and which include, but are not limited to: polymeric binders, particularly in emulsion form, of diene-styrene elastomers, such as butadiene-styrene; acrylonitrile-styrene; copolymers and copolymers with acrylics; acrylic resins; vinyl polymers, such as vinyl halides like homopolymers of polyvinyl chloride or copolymers of the vinyl chloride with vinyl acetate and other vinyl esters and ethers; urethane emulsions, and the like.

The amount of the fibrous sheet material containing the emulsion may vary, but the polymer binding agent often ranges from about 1 to 60% by weight of the sheet material; for example, 20% to 55%. The polymeric latex employed as the binding agent may include other ingredients and additives as desired, such as pigments, dyes, antioxidants, stabilizers, clay fillers, antistatic agents, flame retardants, plasticizers, surfactants, release agents and other additives.

The conductive thin sheet material impregnated with the conductive particles may be applied in a wide variety of footwear, but preferably is applied to disposable-type inexpensive footwear; for example, slippers or foot covers. The Sheet material may be secured to the bottom portion of the footwear to cover all or a portion of the footwear; that is, as a straight strip or shaped as a human foot or being a part of the human foot, but generally extends the length of the footwear, either through sewing, adhesively bonding or securing otherwise the fibrous impregnated sheet material to the bottom of the footwear. In addition, the particle-impregnated sheet material further may be coated with additional layers of conductive particles or conductive material, on one or both sides, prior to securing the sheet material to the footwear.

The sheet material employed is a fibrous material, and particularly a nonwoven fibrous material, composed of cellulosic fibers from cotton or natural fibers for example, 1 to 12 mils in thickness, but may, if desired, be composed also of synthetic fibers or mixtures of natural and synthetic fibers as desired. However, snythetic fibers employed should not be such as to increase the static-retaining properties of the sheet material, and thus the fibers retained normally should be fibers containing hydroxyl groups, such as cellulosic fibers, or the like.

My footwear, thus, in its preferred embodiment, comprises an elastomeric/polymeric binding material in a paper sheet material which is impregnated with particulate conductive particles, such as carbon black, and is secured to the bottom of a disposable slipper, wherein the sheet material provides for nonslip properties of the slipper and provides also for antistatic or electrically conductive properties.

The conductive particles may be incorporated or impregnated into the fibrous sheet material to be secured to the footwear in a number of ways. For example, one way is by dispersing the conductive particles in a solution or emulsion of the polymer, or with the fibers prior to adding the polymer. The conductive particles may include very finely-divided metal particles, alumina-silicate particles, such as synthetic or natural molecular sieves containing water, or carbon-black particles or other carbon particles or graphite fibers, alone or in combination.

In another method, the conductive particles may be dispersed, such as by the use with surfactants in an aqueous composition, and applied onto the ready-formed sheet material, so as to penetrate the sheet material, either from one or both sides, directly after formation of the paper sheet material or after drying of the sheet material. Various other techniques, such as the dusting of conductive particles onto the surface of the paper and subsequently calendering of the paper to impregnate the particles therein, may be employed to impregnate the particles generally uniformly throughout the paper sheet. Also the conductive particles may be dispersed separately, and then added to the polymeric binder; for example, carbon black may be dispersed in water with a dispersive agent (surfactant), and then the dispersant mixed with the polymeric emulsion, and then the material impregnated with this mixture.

My invention will be described in its preferred embodiment in connection with the preparation of electrically conductive paper for use with footwear and with the following examples, but it is recognized that my paper may have other uses and advantages. As will be recognized by a person skilled in the art, various changes and modifications may be made in my invention, all within the spirit and scope of my invention, and without departing therefrom.

DESCRIPTION OF THE EMBODIMENTS

EXAMPLE 1

Figure 1:
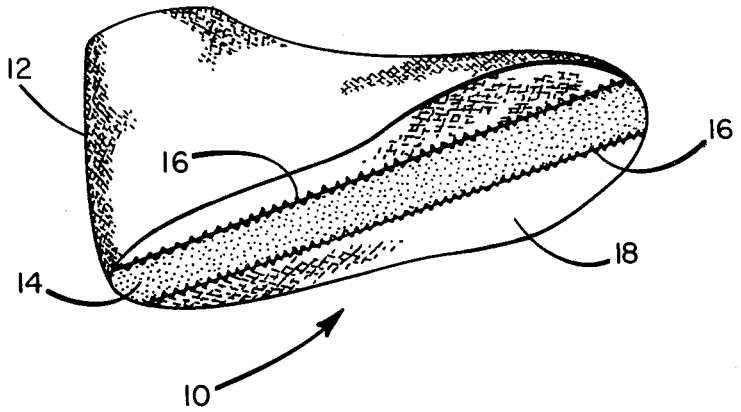
FIG. 1 shows a prospective view of disposable footwear of the invention having secured thereto an electrically conductive sheet material.

A carbon-black dispersion was prepared by adding conductive carbon black in the amount of 16 grams to 83 grams of water at room temperature, adding one gram of a surfactant, and several ml of $NH_4OH$ to adjust the pH. The dispersion was mixed with a laboratory (propellor) mixer for five minutes and then added to a styrene-butadiene latex (17% solids comprised of 55% butadiene and 40% styrene) and the mixture stirred. 10-point paper was dipped into a pan containing this mixture, blotted, and dried on a steam-heated stainless-steel plate. The resulting paper had a 40% weight gain, and resistance of about 500,000 ohms per inch when measured with a volt-ohm meter.

EXAMPLE 2

The carbon black dispersion in Example 1 was further mixed in a high-speed mixer for about 7 minutes. The resulting mixture was very viscous, and was added to the styrene-butadiene latex for a resulting amount of about 40% carbon based on the polymer. The paper was saturated as in Example 1. The resulting paper had a weight gain of about 40% and a surface resistance of about 3,000 ohms per inch.

EXAMPLE 3

The following dispersion was prepared: 80 grams of carbon black was combined with 9.5 grams of Tamol SN (a trademark of Rohm & Haas Co.), 0.53 grams NaOH and 410 grams of water. This mixture was combined in a laboratory mixer and mixed at a high-speed for about 1 minute total in 20-second intervals. The resulting dispersion was very black and appeared to be of a uniform consistency. 44 grams of this dispersion was added to 100 grams of a styrene-butadiene latex 17.6% solids, 55% butadiene and 25% styrene). This resulted in about 40 parts carbon black per 100 parts polymer. The solution was stirred for 30 seconds in the laboratory mixer and added to a pan for paper saturation as in Example 1. The result of this experiment for 10-point paper was a 35.5% weight gain, with a resistance varying from 10,000 to 30,000 ohms per inch. The paper was calendered after treatment, resulting in the higher level resistance. Also, 6-point paper was treated with 36.4% weight gain, resulting in 30,000 to 40,000 ohms per inch without calendering and a 47.7% weight gain, resulting in 5,000 to 7,000 ohms per inch without calendering.

EXAMPLE 4

The latex used in Example 3 was increased to 24.4% solids and the experiment run again. The mixture combined 60 grams with the carbon-black dispersion with 100 grams of rubber latex (now 24% solvent). The resulting 6-point paper from this treatment had a 51% weight gain with a resistance of 9,000 to 15,000 ohms per inch.

EXAMPLE 5

The conductive paper of 6-point thickness in Example 4 was tested for physical properties, and compared with a nonwoven conductive strip used commercially (Will Ross — 45-1094 catalog 46). The tensile strength of the sample in Example 4 had a basis weight of 24 pounds (per ¾" wide strip) with an elongation of 5.8%. The Will Ross strip (¾" wide) had a tensile strength of 7.4 pounds with an elongation of 550%.

EXAMPLE 6

The conductive paper prepared in Example 4 was cut into ¾" wide strips and sewn on the bottom of disposable shoe covers used in hospital operating rooms. The strips were sewn on with both a straight stitch and a zig-zag stitch. The slipper was worn for about 1 hour over smooth surface floors, as well as up and down stone stairs, and was compared with a conventional, commercial, disposable shoe cover which was on the other foot. The conductive strip, as prepared in Example 3, showed little or no abrasion, and the same conductivity after wearing as before. Also, the product showed superior antislip properties on smooth surfaces as compared with the commercial product. In addition, the commercial product displayed abrasion, resulting in fiber removal in the nonwoven material consisting of polyester fibers. This experiment was repeated, with two other personnel testing on a blind-test basis, with the same results in terms of antislip properties and abrasion resistance.

FIG. 1 shows a disposable slipper 10 for use in an operating room with an upper-shoe-encompassing portion 12 and a bottom-floor-contacting or sole portion 18 which has secured thereto by sewing thread 16, a strip 14 of the sheet material of Example 4.

Figure 2:
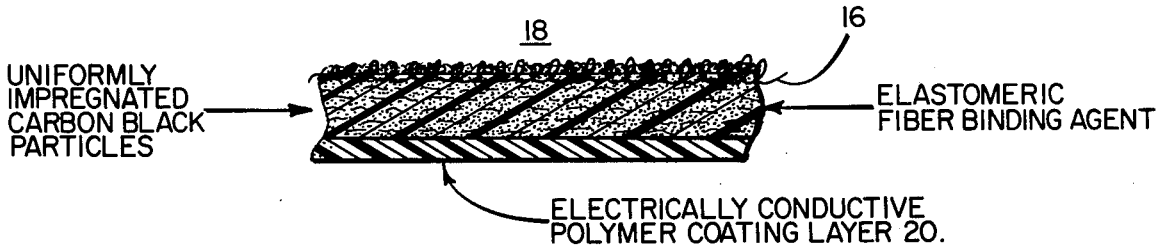
FIG. 2 is an illustrative cross-sectional view of another embodiment of the sheet material.

FIG. 2 is an enlarged cross-sectional view of a sheet material of Example 4 as shown in FIG. 1, except that a polymeric-coating layer of the fiber binding agent and the carbon black has been applied as an additional coating layer 21.

EXAMPLE 7

Shoe covers prepared, as in Example 6, were soaked in tap water at room temperature for about 30 seconds and were compared with the commercial shoe-cover containing the nonwoven conductive strip with a coated conductive material. A shoe cover, as prepared in Example 3 (conductive strip), was compared with the conventional shoe cover by wearing over smooth surfaces. The conductive strip made by this invention exhibited clearly superior antislip properties when wet and when used in walking over smooth surfaces, as compared to the commercial product.

My process also relates to impregnating the paper and rolling or drying, followed by coating the conductive or treated paper, to improve overall properties, or can be used to improve oil resistance. Likewise, a further coating of the conductive polymer mixture used in impregnation may be used to improve further the conductivity of the resulting material.

EXAMPLE 8

The paper prepared in Example 4 was tested for oil resistance by soaking in SAE motor oil (Sun Oil Company). The resistance increased to greater than 1 megohm per inch after one hour of soaking. The paper prepared in Example 4 was further treated with a coating of polyacrylonitrile (latex) containing 44% b.wt carbon dispersion prepared as in Example 3 and the paper sample was tested for oil resistance. The paper maintained a resistance of less than 30,000 ohms per inch after 8 hours immersion.

What I claim is:

1. An article of manufacture which comprises footwear characterized by electrically conductive properties to prevent the accumulation of static charge on the footwear by the user thereof in a hazardous environment, which footwear includes as a bottom floor-contacting portion a thin, flexible, nonwoven, cellulosic fibrous sheet material containing from about 20% to 55% by weight of the sheet material of a polymeric nonskid binding agent for the fibers, and impregnated generally uniformly therethrough with an electrically conductive amount of from about 2% to 20% by weight of the sheet material of an electrically conductive particulate material.

2. The article of claim 1 wherein the conductive particulate material comprises finely-divided carbon-black particles, aluminum silicate particles, graphite fibers, metal particles, and combinations thereof.

3. The article of claim 1 wherein the nonwoven, sheet material comprises a nonwoven cellulosic paper sheet having a thickness of from about 1 to 12 mils in thickness.

4. The article of claim 1 wherein the binding agent for the fibrous sheet material comprises a natural or synthetic elastomeric material, thereby imparting nonskid properties to the thin, flexible sheet material.

5. The article of claim 1 wherein the thin, flexible sheet material is secured as a thin-strip sheet material to the bottom-floor-contacting portion of the footwear.

6. The article of claim 1 wherein the footwear is a disposable shoe cover adapted to be employed over the user's shoe for use in an operating room environment.

7. The article of claim 1 wherein the conductive particulate material has a particle size of less than about 40 millimicrons.

8. The article of claim 1 wherein the conductive particulate material is carbon black which has a nitrogen surface area of from about 100 to 1200 square meters/gram.

9. The article of claim 1 wherein the conductive particulate material comprises carbon black and the binding agent is a styrene-butadiene, acrylic or polyacrylonitrile polymer.

10. The article of claim 1 wherein the sheet material includes a polymeric coating to improve the oil resistance or conductivity of the article.

11. The article of claim 1 wherein the sheet material has been calendered after impregnation of the electrical conductive particulate material.

12. The article of claim 1 wherein the sheet material has a resistance of less than 30,000 ohms per inch.

13. A foot cover having antistatic and electrically conductive properties adapted to be worn in an environment, such as an operating room, over regular shoeware of a user, which foot cover comprises a shoe-encompassing portion and which has secured to the bottom-floor-contacting portion of the foot cover a thin, flexible layer of a nonwoven, paper sheet material, the fibers of the paper sheet bonded together with a polymeric binding agent, and which paper sheet material contains from about 2% to 20% by weight of a particulate carbon-black material having a particle size of from 25 to 35 millimicrons and a nitrogen surface area from 100 to 1200 square meters/gram, the carbon-black material generally uniformly distributed throughout the depth of the sheet material.

14. The foot cover of claim 13 wherein the sheet material comprises from about 20% to 55% by weight of the sheet material of a natural or synthetic elastomeric, nonskid, oil-resistant, polymeric binding agent.

15. The foot cover of claim 13 which includes a polymeric electrically-conductive coating on the impregnated sheet material to improve the electrical conductivity of the sheet material.

* * * * *